US007101033B2

(12) United States Patent
Roche et al.

(10) Patent No.: US 7,101,033 B2
(45) Date of Patent: Sep. 5, 2006

(54) CLEANING MEDIUM FOR INK-JET HARD COPY APPARATUS

(75) Inventors: Wesley Baxter Roche, Vancouver, WA (US); Le Pham, Vancouver, WA (US); Wade A. Powell, Vancouver, WA (US); Steven P. Downing, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/704,852

(22) Filed: Nov. 10, 2003

(65) Prior Publication Data

US 2004/0095450 A1 May 20, 2004

Related U.S. Application Data

(63) Continuation of application No. 09/584,019, filed on May 30, 2000, now Pat. No. 6,698,878.

(51) Int. Cl.
*B41J 2/01* (2006.01)

(52) U.S. Cl. ..... 347/104; 347/33

(58) Field of Classification Search ..... 347/22–36, 347/104; 400/635

See application file for complete search history.

(56) References Cited

U.S. PATENT DOCUMENTS

| | | | | |
|---|---|---|---|---|
| 4,947,190 | A * | 8/1990 | Mizusawa et al. | 347/33 |
| 5,055,861 | A * | 10/1991 | Murayama et al. | 347/29 |
| 5,423,411 | A * | 6/1995 | Kennett | 198/494 |
| 5,605,750 | A | 2/1997 | Romano et al. | |
| 5,757,407 | A | 5/1998 | Rezanka | |
| 5,764,263 | A * | 6/1998 | Lin | 347/101 |
| 6,053,648 | A | 4/2000 | Mistyurik | |
| 6,129,019 | A * | 10/2000 | Tobol et al. | 101/424 |
| 6,168,261 | B1 | 1/2001 | Miyake et al. | |
| 2001/0020963 | A1 * | 9/2001 | Fukushima et al. | 347/33 |

FOREIGN PATENT DOCUMENTS

| | | | |
|---|---|---|---|
| JP | 02-8078 | * | 1/1990 |
| JP | 405131618 | | 5/1993 |

* cited by examiner

*Primary Examiner*—Manish S. Shah
*Assistant Examiner*—Ly T. Tran

(57) ABSTRACT

A printing system includes a printhead, a movable transport surface opposite the printhead and configured to transport a print medium relative to the printhead, and a cleaning medium in contact with the transport surface while at least one of the cleaning medium and the transport surface are moved relative to one another.

18 Claims, 3 Drawing Sheets

PLATEN/HEATERS
VACUUM 306
32
40
36
37
34
38
31
201
204
205
301
303
304
305
401
402

CLEANING MEDIUM FOR INK-JET HARD COPY APPARATUS

CROSS-REFERENCE TO RELATED PATENT APPLICATIONS

The present continuation application claims priority under 35 U.S.C. § 120 from U.S. patent application Ser. No. 09/584,019 filed on May 30, 2000 now U.S. Pat. No. 6,698,878, by Wesley B. Roche et al., and entitled "Cleaning Medium for Ink-Jet Hard Copy Apparatus", the full disclosure of which is hereby incorporated by reference.

BACKGROUND OF THE INVENTION

The present invention relates generally to ink-jet printing and, more specifically to a method and mechanism for cleaning a belt used in the transport of print media through a printing zone.

The art of ink-jet technology is relatively well developed. Commercial products such as computer printers, graphics plotters, copiers, and facsimile machines employ ink-jet technology for producing hard copy. The basics of this technology are disclosed, for example, in various articles in the *Hewlett-Packard Journal*, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions. Ink-jet devices are also described by W. J. Lloyd and H. T. Taub in *Output Hardcopy [sic] Devices*, chapter 13 (Ed. R. C. Durbeck and S. Sherr, Academic Press, San Diego, 1988).

FIG. 1 (Prior Art) is a schematic depiction of an ink-jet hard copy apparatus 10. A writing instrument 12 is provided with a printhead 14 having drop generators including nozzles for ejecting ink droplets onto an adjacently positioned print medium, e.g., a sheet of paper 16, in the apparatus' printing zone 34. An endless-loop belt 32 is one type of known manner printing zone input-output paper transport. A motor 33 having a drive shaft 30 is used to drive a gear train 35 coupled to a belt pulley 38 mounted on an fixed axle 39. A biased idler wheel 40 provides appropriate tensioning of the belt 32. The belt rides over a platen 36 in the print zone 34; the platen is described in detail hereinafter, but is associated with a known manner vacuum induction system 37. The paper sheet 16 is picked from an input supply (not shown) and its leading edge 54 is delivered to a guide 50, 52 where a pinch wheel 42 in contact with the belt 32 takes over and acts to transport the paper sheet 16 through the printing zone 34 (the paper path is represented by arrow 31). Downstream of the printing zone 34, an output roller 44 in contact with the belt 32 receives the leading edge 54 of the paper sheet 16 and continues the paper transport until the trailing edge 55 of the now printed page is released. The carriage scanning axis is conventionally designated the x-axis, the print media transit axis is designated the y-axis, and the printhead firing direction is designated the z-axis. For convenience in describing the art and the present invention, all types of ink-jet hard copy apparatus are sometimes hereinafter referred to as "printers;" all types, sizes, and compositions of print media—including non-traditional printing media such as polymeric transparencies, cloth fabric, mylar, and the like—are also referred to simply as "paper;" all compositions of colorants are sometimes referred to as "ink;" and all embodiments of an ink-jet writing instruments are simply referred to as a "pen;" no limitation on the scope of the invention is intended nor should any be implied.

During printing operations, ink deposits or aerosol mixtures of ink and paper dust collect on the belt and platen. Once on the belt, ink begins transferring onto subsequent sheets as well as internal components of the print mechanism. This can cause print defects and unattractive splotches on the reverse side of the print. Thus, there is a need for paper transport belt cleaning mechanisms.

SUMMARY OF THE INVENTION

In one basic aspect, the present invention provides a cleaning medium for feeding through an ink-jet apparatus print zone to clean a paper transport belt, including: an absorbent material layer having a surface for frictional contact with the belt such that friction between the absorbent material layer and the belt scrubs ink from the belt and ink is absorbed into the material layer.

In another basic aspect, the present invention provides method for cleaning an ink-jet paper, endless loop, transport belt including the steps of: feeding a cleaning medium from an input into a print zone wherein the cleaning medium is in surface-to-surface contact with the belt; passing the cleaning medium through the print zone such that the belt is in contact thereagainst; absorbing ink from the belt into the cleaning medium; and releasing the cleaning medium from the print zone.

In another basic aspect, the present invention provides ink-jet hard copy system including: an endless loop belt for conveying media from an input through a printing zone to an output; an ink-jet writing instrument positioned for depositing ink in the printing zone; a feed device for guiding media from the input to the belt and for selectively holding a sheet of media in the printing zone irrespective of movement of the belt; and at least one cleaning medium associated with the feed device for selectively scrubbing the belt.

In another basic aspect, the present invention provides cleaning medium for cleaning a transport apparatus for sheet material, including: a cleaning material construct having at least one surface for contact with components of the sheet transport device wherein the construct is fed into the sheet transport device in like manner as the sheet material.

Some advantages of the present invention are:

- it dissolves ink and absorbs ink from the belt and other components in the paper path that can be contaminated;
- it scrubs the belt of contaminants that can affect its functionality;
- it requires no additional mechanisms to be incorporated into the hard copy apparatus;
- it assists in removing contaminants from the platen surface below the belt; and
- disposability makes the invention a low cost; reliable solution.

The foregoing summary and list of advantages is not intended by the inventors to be an inclusive list of all the aspects, objects, advantages and features of the present invention nor should any limitation on the scope of the invention be implied therefrom. This Summary is provided in accordance with the mandate of 37 C.F.R. 1.73 and M.P.E.P. 608.01(d) merely to apprise the public, and more especially those interested in the particular art to which the invention relates, of the nature of the invention in order to be of assistance in aiding ready understanding of the patent in future searches. Other objects, features and advantages of the present invention will become apparent upon consideration of the following explanation and the accompanying drawings, in which like reference designations represent like features throughout the drawings.

The drawings referred to in this specification should be understood as not being drawn to scale except if specifically noted.

DETAILED DESCRIPTION OF THE PREFERRED EMBODIMENTS

Reference is made now in detail to a specific embodiment of the present invention, which illustrates the best mode presently contemplated by the inventors for practicing the invention. Alternative embodiments are also briefly described as applicable. The implementation, shown in conjunction with an ink-jet printer, is for convenience in explaining the present invention and no limitation on the scope of the invention is intended by the inventors nor should any be implied.

Figure 1:
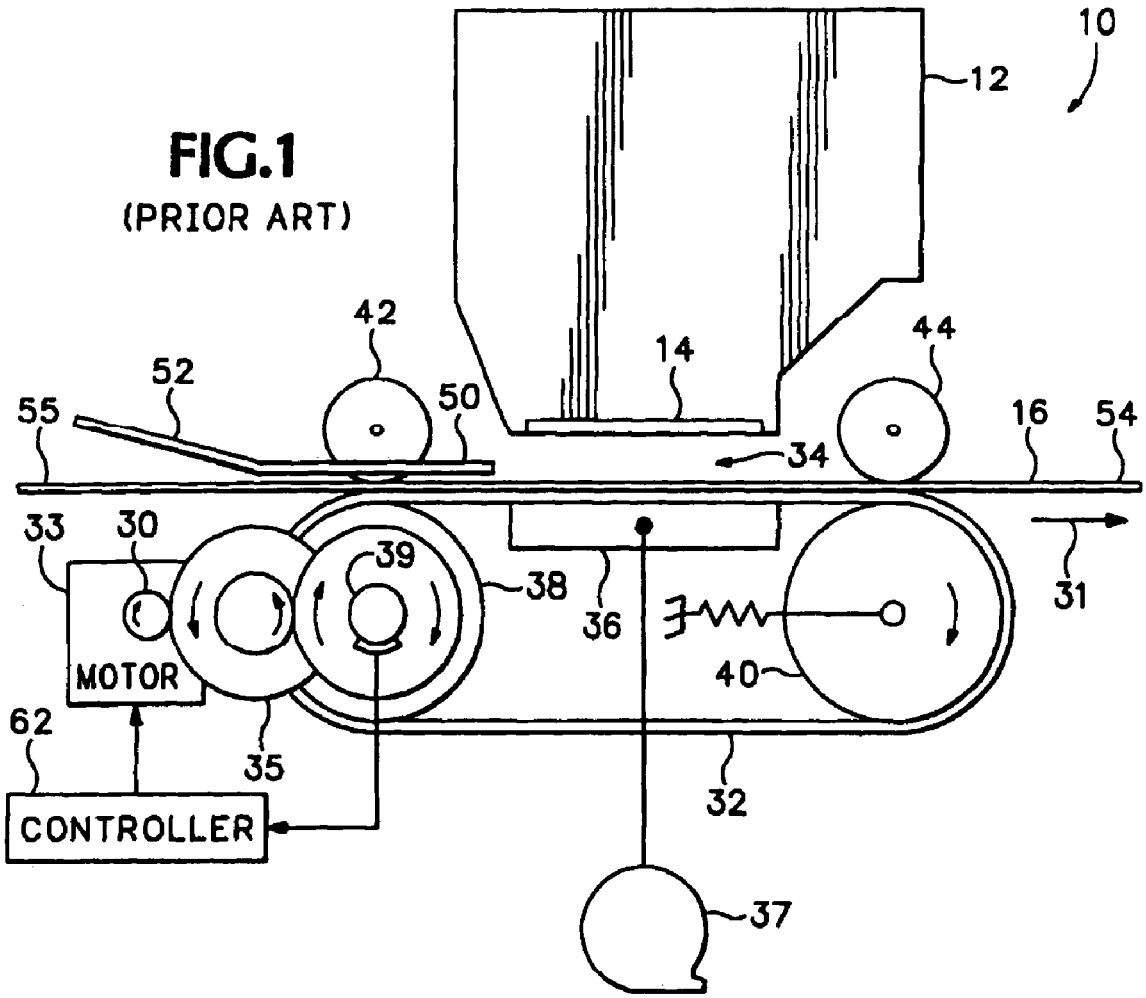
FIG.1 (PRIOR ART)
FIG. 1 (Prior Art) is a schematic illustration of an ink-jet hard copy apparatus.

To clean a paper transport belt 32 as shown in FIG. 1, or a like state-of-the art, belt transport ink-jet printer 10, both wet and dried ink deposits need to be loosened, then removed from the belt and the printer environment.

Figure 2:
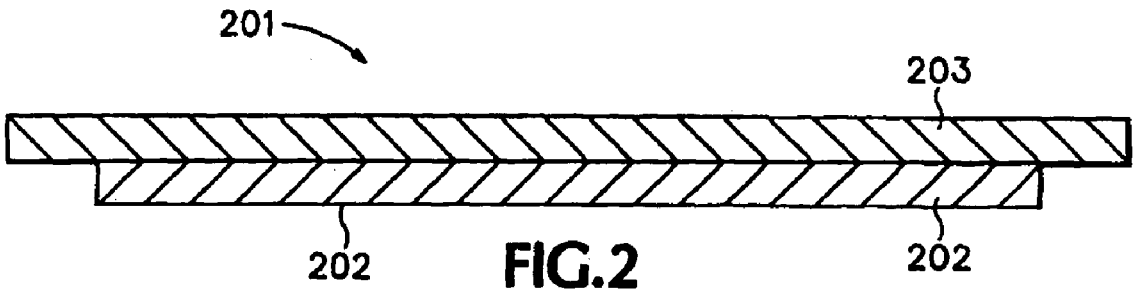
FIG. 2 is a schematic illustration of a cross-section of a cleaning medium in accordance with the present invention.

FIG. 2 depicts a preferred embodiment of a two-piece, disposable, cleaning medium 201 in accordance with the present invention. An absorbent material layer 202 will be used to scrub the belt 32. While a dry absorbent material layer 202 can be employed, the effectiveness of the cleaning process is markedly improved if the absorbent material layer 202 has an outer surface 202', with a solvent or solvent solution associated with the ink formula used in the pen 12. Exemplary materials for the absorbent material layer 202 that have been found suitable to an ink-jet printer environment are cellulose-based fabric (such as used in commercially available shop towels), lint-free Chem-Wipes™, thermal-bonded non-woven textiles and absorbent lint-free papers. For water-based ink formulations, an exemplary solvent solution may be water, de-ionized water, or a hydrosolution using a surfactant such as tergitol-S-5, or alkaline (sodium bicarbonate) or potassium hydroxide (KOH) or using an active solvent such as polyethylene glycol (PEG) or isopropanol (IPA). The solvent solution formation can be tailored empirically for any specific implementation.

A backing layer 203 secured to the absorbent material layer 202 may be used if the absorbent material layer is not sufficiently rigid; a polymer film has been found to provide sufficient added stiffness. The backing sheet 203 should have a stiffness suitable for ensuring that no paper jam occurs. Thermal-bonding, mechanical bonding, or the use of a material-compatible, known adhesive can be employed for mounting the absorbent material layer 202 with the backing layer 203.

If the pen 12 is a stationary instrument, such as a page wide array, the overall thickness of the cleaning medium 201 must be such that it can pass through the printing zone 34 without contacting the printhead 14. Otherwise, a mechanism for lifting the array should be provided. If the pen 12 is a scanning type, it is parked in its service station (not shown) during the belt cleaning cycle.

Figures 3, 4, 5:
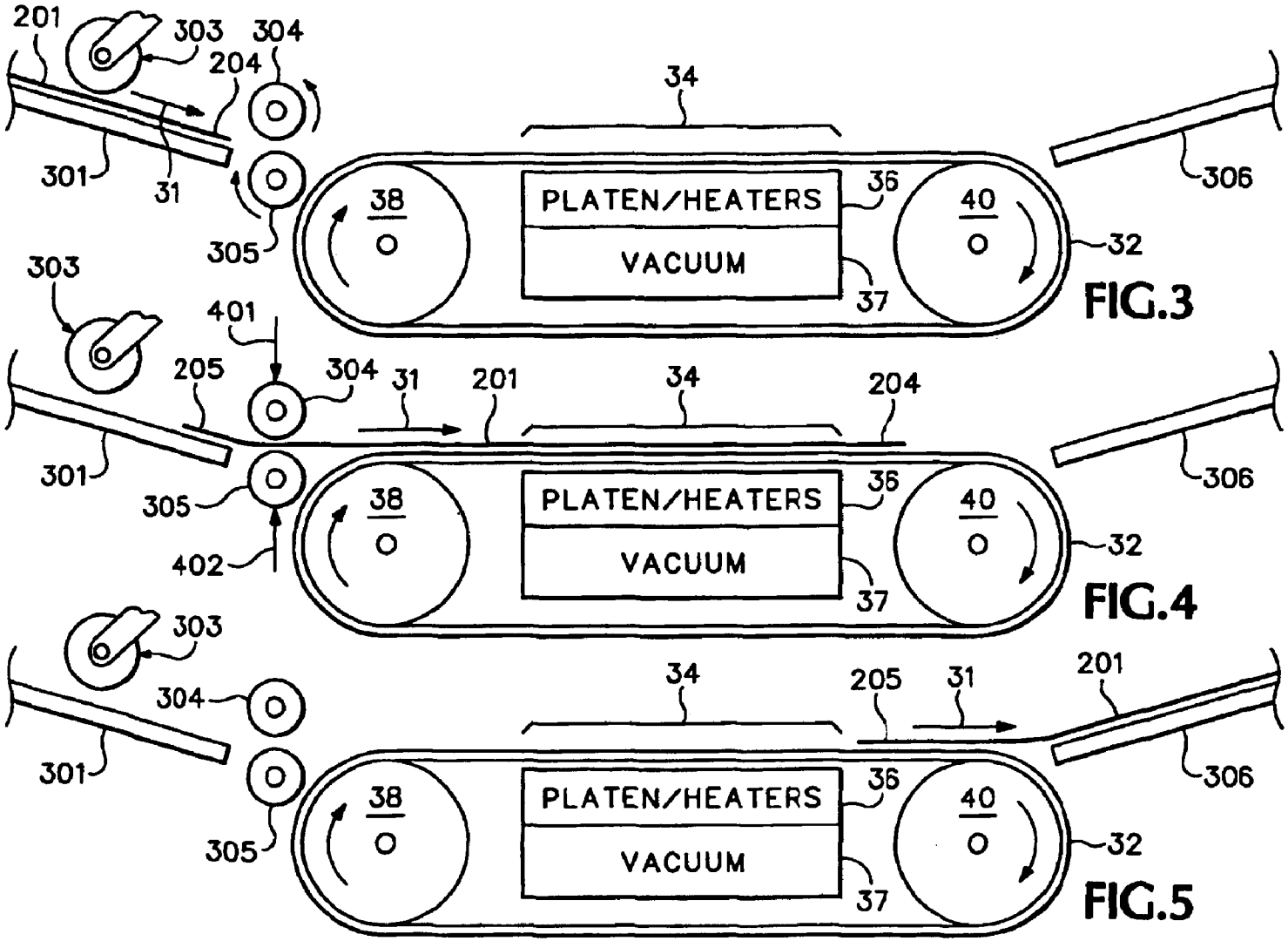
FIG. 3 is a schematic illustration in accordance with the present invention demonstrating the cleaning medium of FIG. 2 in an input tray of a hard copy apparatus.
FIG. 4 is a schematic illustration of the present invention with the cleaning medium in a printing zone of the hard copy apparatus as shown in FIG. 3 during belt and platen cleaning.
FIG. 5 is a schematic illustration of the present invention with the cleaning medium in an output tray of the hard copy apparatus as shown in FIGS. 3 and 4.
Figure 6:
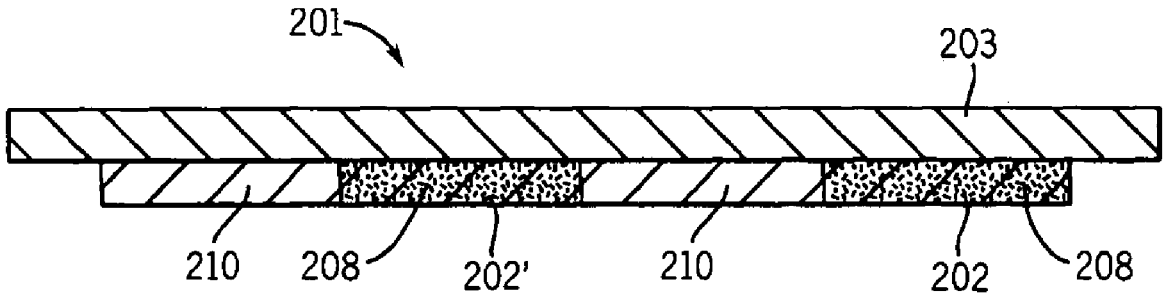
FIG. 6 is a sectional view of another embodiment of the cleaning medium of FIG. 2.

When belt cleaning is necessary—for example, when the end-user notices ink markings on the back of a print—the cleaning medium 201 is loaded and run through the paper path 31 of the apparatus as demonstrated in FIGS. 3, 4 and 5. The cleaning medium 201 is loaded into the input tray 301 by the end-user, either as the only sheet in the input tray or in any special media tray provided by the apparatus manufacturer for single sheet feed cycles (often provided so that special media, such as transparencies, can be run through a printing cycle without unloading the standard paper tray with the absorbent material layer 202 oriented to come into contact with the belt 32 outer surface. A pick mechanism 303 is engaged to transfer the leading edge 204 of the cleaning medium 201 into a nip between two feed rollers 304, 305 upstream of the print zone 34, at least one of the feed rollers is actively driven by a motor (not shown) such that the two feed rollers engage the cleaning medium 201 and drive it along the paper path 31 and into the print zone as illustrated by FIG. 4. Once the cleaning medium 201 is thus loaded in the print zone 34, the feed rollers 304, 305 are stopped—or at least substantially slowed—so that the cleaning medium 201 is substantially held stationary in the print zone 34 by the normal force (arrows 401, 402) of the feed rollers while the belt 32 continues to be driven by the belt drive wheels 38, 40. This causes a wiping action between the cleaning medium 201 absorbent material layer 202(FIG. 2 only) and the belt 32 outer surface. The solvent, when employed, rehydrates ink deposits on the belt 32. Moreover, as the belt 32 is porous, it has been found that the solvent can penetrate the belt and rehydrates any ink deposits on the subjacent platen 36. The added abrasion between the belt outer surface and the absorbent material layer 202 by fully stopping the cleaning medium in the print zone 34 improves the cleaning of the belt 32.

It has been found that indexing the cleaning medium 201 in steps 201 in steps through the print zone 34 so that a clean portion of the cleaning medium 201 is brought into contact with the belt 32 for incremental belt advance, for each semi-rotation or full rotation cycle, or for multiple rotations improves the scrubbing results. In other words, the cleaning medium 201 advance into the print zone 34 is first stopped with just a region adjacent to the leading edge 204 in contact with the belt 32; scrubbing is permitted for a predetermined time or distance; then, the cleaning medium is again advanced another predetermined distance into the print zone 34 and stopped again; then, the stepping proceeds such that a fresh region of the cleaning medium 201 is sequentially brought into contact with an even cleaner belt surface. To ensure full belt cleaning, the cleaning medium 201 width should be at least as great as the width of the belt 32.

A known-manner output or platen heater (not shown) can be used to dry the cleaning medium 201 before transporting it to an output tray, preventing the solvent from being transferred onto output transport components or into the output tray. Such heating will also ensure the belt 32 is dried before the next printing cycle begins.

Note also that the cleaning medium 201 can be segregated into alternating solvent soaked regions and dry regions for sequential contact with the belt 32 surface during the cleaning cycle.

Some solvents will be more aggressive when heated. Therefore, it is advantageous to incorporate heat transfer from the platen 36 to the cleaning medium 201 via the intermediate belt 32.

As shown in FIG. 5, after a predetermined time, or number of steps, the trailing edge 205 of the cleaning medium 201 is released by the feed rollers 304, 305. The belt 32 delivers the used cleaning medium 201 to an output tray 306 where it can be removed and properly disposed of by the end-user.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. For example, a known manner solvent dispensing subsystem can be incorporated in the hard copy apparatus and used. The cleaning medium may be fed from a replaceable roll rather than being in sheet form. The belt 32 may be the type having a friction surface rather than be a vacuum belt. The vacuum, however, will improve scrubbing as the absorbent layer 202 will be pulsed more tightly against the belt's outer surface in the print zone 34. This can also be achieved with no vacuum by using a pinch force over the platen.

Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for . . . ."

What is claimed is:

1. A printing system comprising:

a printhead;

a movable transport surface opposite the printhead such that printhead and the surface directly face one another, wherein the transport surface is configured to transport a print medium relative to and across the printhead;

a cleaning medium comprising a sheet configured to contact the surface when at least one of the cleaning medium and the surface are moved relative to one another at different speeds to produce wiping therebetween; and an arrangement configured to feed the cleaning medium from a first position in which the cleaning medium is not in contact with the transport surface and a second position in which the cleaning medium is in contact with the transport surface.

2. The system of claim 1 including an arrangement configured to hold the cleaning medium stationary as the transport surface is moved relative to the cleaning medium.

3. The system of claim 1 including an endless loop transport belt providing the transport surface.

4. The system of claim 1, wherein the cleaning medium has a cleaning surface including a solvent.

5. The system of claim 4, wherein the cleaning surface has a first portion including the solvent and a second portion excluding the solvent.

6. The system of claim 5, wherein the cleaning surface includes a third portion including the solvent and wherein the second portion is between the first portion and the third portion.

7. The system of claim 1, wherein the cleaning medium is removably supported within the printing system.

8. The system of claim 1, wherein the cleaning medium has a cleaning surface and wherein at least a portion of the cleaning surface is absorbent.

9. The system of claim 1, wherein the cleaning medium includes:

a first layer having a first stiffness and providing a cleaning surface; and a second layer coupled to the first layer and having a second greater stiffness.

10. The system of claim 9, wherein the cleaning medium has a composite stiffness sufficient to prevent the medium from jamming within the printing system.

11. The system of claim 1, wherein the arrangement is configured to sequentially move and stationarily retain portions of the cleaning medium into contact with the transport surface.

12. An ink-jet hard copy apparatus comprising:

a ink-jet printhead;

a surface opposite the printhead such that printhead and the surface directly face one another;

a cleaning medium comprising a sheet;

means for moving the surface relative to the cleaning medium at a different speed than any movement of the medium in a direction across the printhead while in contact with the cleaning; and means for feeding the cleaning medium from a first position in which the cleaning medium is not in contact with the surface and a second position in which the cleaning medium is in contact with the surface and for holding the cleaning medium stationary as the surface is moved relative to the cleaning medium.

13. The apparatus of claim 12, wherein the cleaning medium is configured to contact the surface while extending opposite the printhead when at least one of the cleaning medium and the surface are moved relative to one another.

14. A printing system comprising:

a printhead;

a movable transport surface opposite the printhead such that printhead and the surface directly face one another, wherein the transport surface is configured to transport a print medium relative to and across the printhead;

a cleaning medium configured to contact the surface when at least one of the cleaning medium and the surface are moved relative to one another at different speeds to produce wiping therebetween; and an arrangement configured to feed the cleaning medium from a first position in which the cleaning medium is not in contact with the transport surface and a second position in which the cleaning medium is in contact with the transport surface, wherein the arrangement is configured to hold the cleaning medium stationary as the transport surface is moved relative to the cleaning medium.

15. The system of claim 14, wherein the cleaning medium is configured to contact the surface while extending opposite the printhead when at least one of the cleaning medium and the surface are moved relative to one another.

16. The system of claim 14, wherein the arrangement is configured to sequentially move and stationarily retain portions of the cleaning medium into contact with the transport surface.

17. A printing system comprising:

a printhead;

a movable transport surface opposite the printhead such that printhead and the surface directly face one another, wherein the transport surface is configured to transport a print medium relative to and across the printhead; and a cleaning medium comprising a sheet configured to contact the surface when at least one of the cleaning medium and the surface are moved relative to one another at different speeds to produce wiping therebetween; and an arrangement configured to hold the cleaning medium stationary as the transport surface is moved relative to the cleaning medium.

18. A printing system comprising:

a printhead;

a movable transport surface opposite the printhead such that printhead and the surface directly face one another, wherein the transport surface is configured to transport a print medium relative to and across the printhead;

a cleaning medium configured to contact the surface when at least one of the cleaning medium and the surface are moved relative to one another at different speeds to produce wiping therebetween; and an arrangement configured to feed the cleaning medium from a first position in which the cleaning medium is not in contact with the transport surface and a second position in which the cleaning medium is in contact with the transport surface, wherein the arrangement is configured to sequentially move and stationarily retain portions of the cleaning medium into contact with the transport surface.

* * * * *

UNITED STATES PATENT AND TRADEMARK OFFICE

CERTIFICATE OF CORRECTION

PATENT NO. : 7,101,033 B2
APPLICATION NO. : 10/704852
DATED : September 5, 2006
INVENTOR(S) : Wesley Baxter Roche et al.

It is certified that error appears in the above-identified patent and that said Letters Patent is hereby corrected as shown below:

Delete Drawing FIG. 2

“ 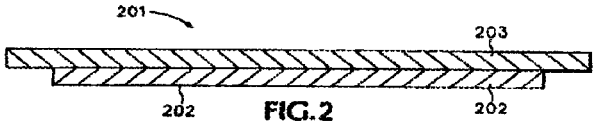

FIG.2 ” and insert -- 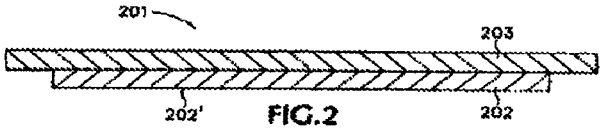

FIG.2 --, therefor.

In column 6, line 37, in Claim 12, after “cleaning” insert -- medium --.

Signed and Sealed this

Sixth Day of January, 2009

JON W. DUDAS
*Director of the United States Patent and Trademark Office*